United States Patent [19]

Kröner

[11] Patent Number: 4,704,037

[45] Date of Patent: Nov. 3, 1987

[54] WATCH OPERATING MECHANISM MOUNTING ARRANGEMENT

[75] Inventor: Wolfgang Kröner, Pforzheim, Fed. Rep. of Germany

[73] Assignee: Pforzheimer Uhren-Rohwerke PORTA GmbH, Pforzheim, Fed. Rep. of Germany

[21] Appl. No.: 874,009

[22] Filed: Jun. 13, 1986

[51] Int. Cl.[4] ..... G04C 10/00

[52] U.S. Cl. ..... 368/203; 368/88

[58] Field of Search ..... 368/203, 204, 88, 276, 368/821

[56] References Cited

U.S. PATENT DOCUMENTS 4,362,396 12/1982 Perrot ..... 368/203

FOREIGN PATENT DOCUMENTS 2072897 10/1981 United Kingdom ..... 368/203

*Primary Examiner*—Bernard Roskoski

[57] ABSTRACT

In a mounting arrangement for a wristwatch operating mechanism wherein a base plate carries a circuit board and other circuit components and has a cavity for the reception of a battery with a connector strap extending between the battery cavity and the circuit board for electrical connection of one battery pole with the appropriate contact of the circuit board, the circuit board is mounted on the base by a single screw which extends through the board and at the same time through one end of the connector strap so as to firmly engage the connector strap with the appropriate contact of the circuit board, the connector strap having a full coating of insulating material except for the contact areas with the battery and the circuit board.

6 Claims, 2 Drawing Figures

WATCH OPERATING MECHANISM MOUNTING ARRANGEMENT

BACKGROUND OF THE INVENTION

The invention relates to a watch operating mechanism mounting arrangement including a connector strap for the connection of a battery pole (button cell) with the contact area of a circuit board all components being disposed and retained in a battery-operated watch, especially a wristwatch.

The electric or electronic equipment of a small watch consists esentially of an energy source, that is, a battery, an electronic component block including a quartz, integrated circuitry and a stepping motor. The integrated circuitry (IC) together with the quartz are disposed on a circuit board which also carries the power supply conductors for the stepping motor as well as the connecting contact strap for the supply of power. In some watches also the quartz is separately mounted and connected to the circuit board by appropriate conductors.

Since the battery is capable of supplying energy to the watch drive mechanism only for a limited time, the battery needs to be replaced after given periods of operation. For this purpose the battery must be easily disconnectable from the conductors interconnecting the battery with the circuit board. Such a removable connection is provided by way of a base plate or housing of the watch drive into which the battery is fitted and by way of a connector strap which is arranged insulated with regard to the watch housing and which resiliently abuts the battery. In some watch models, especially the more expensive models, it is desirable to be able to exchange also the circuit board and also at least the coil of the motor. However, these components are generally mounted to the watch drive structure by a number of fastening means, such that an exchange of the electronic block, that is, the circuit board, the quartz and the stepping motor, is generally not an easy task.

It is therefore the object of the present invention to provide an arrangement in which the exchange of these components is relatively easy, that is, to provide a mounting arrangement for the electronic block which facilitates its replacement and which, furthermore facilitates manufacture of the respective parts, especially the connector strap between the battery and the circuit board and which in addition facilitates and reduces the expense of assembly of the watch.

SUMMARY OF THE INVENTION

This object is achieved by a mounting arrangement for the operating mechanism of a small watch wherein a base or housing plate carries a circuit board and other electric circuit components and has a cavity for the reception of a battery with a connector strap extending between the battery cavity and the circuit board for electrical connection between the battery and the appropriate contact of the circuit board. The connector strap has a full coating of insulating material except for the contact areas with the battery and the circuit board contact. The circuit board with all electronic components thereon and also the strap are mounted, and all circuit board external contacts are firmly established, by a single circuit board mounting screw which also extends through the board and also the connector strap beneath.

With such an arrangement of connector strap and electronic block, all components are connected together in place by a single screw and secured in the watch operating mechanism by the same screw. It is therfore sufficient to unscrew only a single screw in order to replace the electronic block, the quartz and also the coil of the stepping motor or at least the connector leading to the coil. As a result, difficult, tedious, time consuming and expensive maintenance work is avoided. With the connector strap arrangement according to the invention, no additional insulating materials are required so that they are not only saved but also do not need to be mounted in the watch operating mechanism. Most important, however, that is, more important than the savings in cost of the eliminated materials and mounting points, are the savings in space which permit the watch operating mechanism to be smaller and also the watch to be made smaller and slimmer.

The insulating layer of the connector strap may be an insulating coating or an insulating diffusion layer. It is also possible to provide for an insulating surface layer on the connector strap by a galvanizing process. It is to be taken into account that the kind of watches under consideration are operated by batteries of relatively low voltage so that the resistance of the insulating layer also needs to be only relatively low.

The batteries of such watch operating mechanisms are usually disposed in an appropriate cavity formed in the operating mechanism and are held in the cavity by a resilient retaining member called a battery bracket. This bracket is preferably so formed that its dimensions adjacent the battery correspond to the size of the battery cavity cross-section such that the bracket is properly placed in position. In order to retain the bracket securely in its proper position the bracket may be provided with pins of insulating material which project from the bracket and are received in appropriate bores in the watch operatng mechanism base plate.

In order to securely connect the contacts on the circuit board with the current conducting housing and the connector strap, the contact surface areas are arranged at one side of the circuit board for contact with the connector strap and those for contact with the current conducting housing are arranged at the opposite side of the circuit board and the single mounting screw extends through the circuit board and further the head of the mounting screw is in engagement with the housing contact structure of the circuit board. With this arrangement the watch operating mechanism is firmly mounted by a single screw and at the same time good contact of the housing and the connector strap with the respective circuit board contacts is assured.

In order to facilitate also the mounting of the circuit board suitably together with the quartz and the connecting conductors for the stepping motor, that is, to eliminate the need for positioning of the board, the circuit board is so dimensioned that its outer edges at least partially abut the positioning surface areas of the watch operating mechanism base plate. For mounting of the electronic block possibly together with the quartz and the stepping motor coil only the connector strap and the circuit board have to be inserted in the mechanism and fastened thereto by way of the single mounting screw. After insertion of the battery the operating mechanism is operable at least as far as its electronic or electric components are concerned.

SHORT DESCRIPTION OF THE DRAWINGS

FIG. 1 is a plan view of the watch operating mechanism according to the invention; and FIG. 2 is a view of a cross-section along the arrangement of the connector strap.

DESCRIPTION OF A PREFERRED EMBODIMENT

Figure 1:
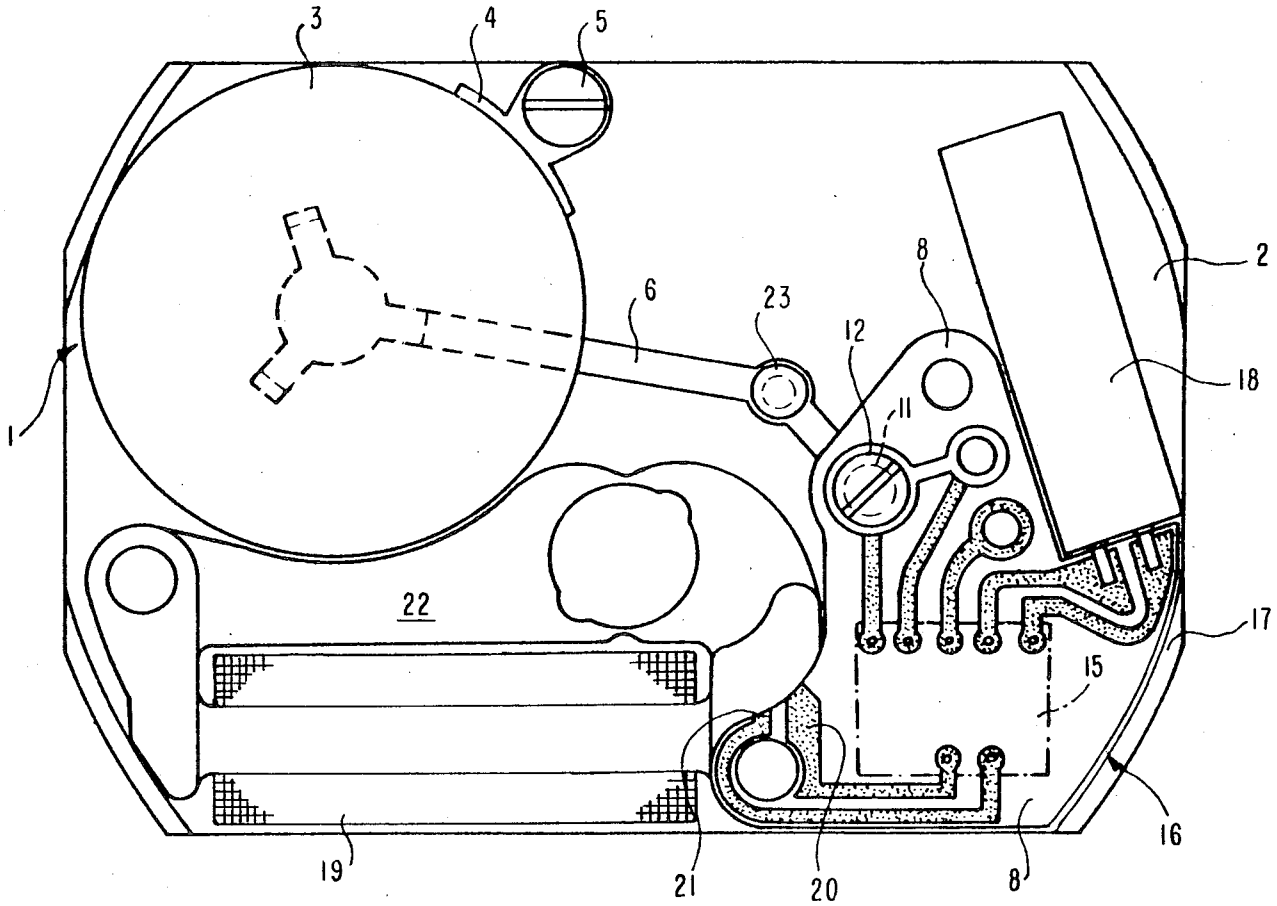
Figure 2:
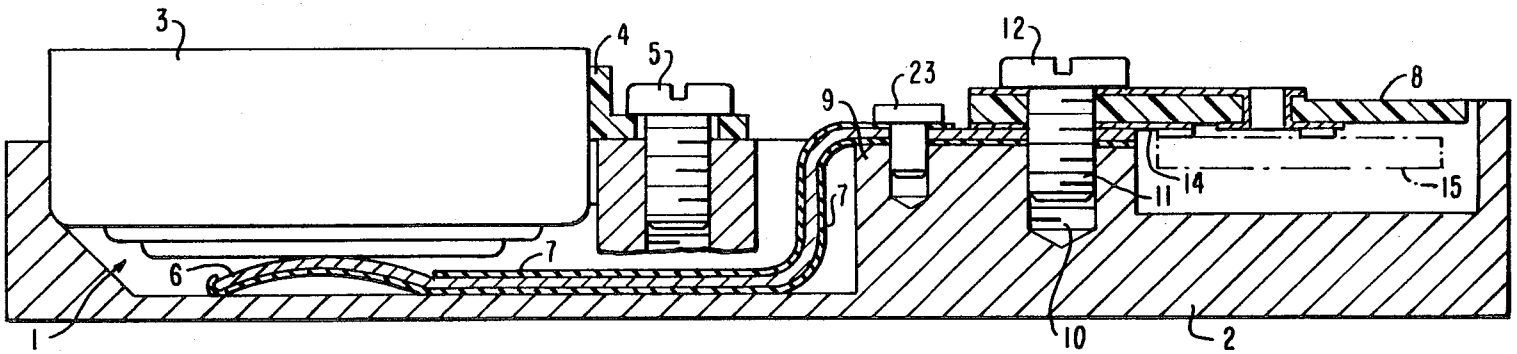

A small watch as shown in FIGS. 1 and 2 includes in a housing or base plate 2 a drive mechanism disposed on a mounting platform 9 which is provided with a cavity 1 in which the watch battery 3 is disposed. The battery 3 is retained in position w ithin the housing by a slide member 4 fastened by a screw 5 which at the same time insures electrical contact of one pole of the battery 3 with the housing or base plate 2. The opposite pole of the battery 3 is disposed on a connector strap 6 which has a resilient portion formed below the battery. The connector strap 6 is provided with an insulating layer 7 extending all around the strap. Only the area of contact with the battery 3 and with the contact at the circuit board 8 are bare such that electrical contact is provided for the connector strap at the battery pole as well as at the circuit board 8. From the battery 3 the connector strap 6 extends up to a mounting platform 9 which has a threaded bore 10 for the reception of the mounting screw 11. The mounting screw 11 extends through an opening n the circuit board 8, the head 12 of the mounting screw 11 being disposed on on a contact area of the circuit board 8 and forcing a contact area 14 on the underside of the circuit board 8 onto the bore end section of the conector strap 6. As a result by this kind of mounting by way of the mounting screw 11, the connector strap 6 and the circuit board 8 are fastened and, at the same time, the contacts of the circuit board with the housing at one side and with the connector strap 6 at the same time, the contacts of the circuit board with the housing at one side and with the connector strap 6 at the other are safely made. Below the circuit board 8 there is shown by dash-dotted lines an integrated circuit component 15. This integrated circuit component 15 is connected to the appropriate contacts of the circuit board 8 in the manner well known in the art.

The plan view of FIG. 1 shows the shape and relative size of the circuit board 8, that is, it shows the circuit board 8 with an edge 16 abutting a positioning wall 17 of the watch housing 1. This view also shows the quartz 18 and the stepping motor coil 19 with the power supply strips 20 and 21 for the coil 19 of the stepping motor 22.

In order to further simplify mounting of the electronic block, the connector strap 6 is held in position by a pin 23 of insulating material extending into a bore on the base plate 2 so that the strap 6 remains held in position by the pin 23 even if the electronic block is removed and also during the replacement of the battery 3.

What is claimed is:

1. An electric watch operating mechanism mounting arrrangement especially for a wristwatch, comprising a base plate, a circuit board, an integrated circuit component and a quartz oscillator all mounted on said base plate, said base plate further having a cavity for the reception of a battery and a connector strap extending between said battery cavity and said circuit board for electrical connection between a battery disposed in said cavity and the appropriate contact of said circuit board, said connector strap having a layer of insulating material disposed all over its surfaces except for the contact areas with said battery and with said circuit board contact and said connector strap also including a pin of insulating material mounted thereon and extending tightly fitting into a bore formed in said base plate for retaining said connector strap in position on said base plate, said battery contact area being shaped so as to resiliently abut a battery disposed in said battery cavity and said circuit contact area being engaged by a mounting screw extending through said connector strap and said circuit board for mounting said circuit board onto said base plate and, at the same time firmly engaging said circuit board connector strap contact area with the appropriate contact of said circuit board.

2. An arrangement according to claim 1, wherein said layer of insulating material on said connector strap is galvanized onto the strap surface.

3. An arrangement according to claim 1, wherein said layer of insulating material on said connector strap is a diffusion layer.

4. An arrangement according to claim 1, wherein said battery cavity is adapted in shape to closely fit said battery and wherein an adjustable slide member is provided at the side of said battery cavity and adapted to engage the battery from the side thereof for retaining said battery within said cavity, and wherein the dimensions of said connector strap at the battery contact end are adapted to the configuration of said battery cavity so as to automatically position itself properly when being mounted onto said base plate.

5. An arrangement according to claim 1, wherein the contact on said circuit board for contact with the circuit board contact area of said connector strap is disposed on the underside of said circuit board and the circuit board's contact for the battery's other pole is disposed on the upper side of the circuit board and wherein said mounting screw has a head in engagement with and abutting the contact area of said other pole and at the same time engaging the connector strap's end firmly with the appropriate contact of the circuit board.

6. An arrangement according to claim 1, wherein the circuit board is so dimensioned that it fits a positioning wall of said base plate.

* * * * *